US005235820A

United States Patent [19]

Radermacher et al.

[11] Patent Number: 5,235,820

[45] Date of Patent: Aug. 17, 1993

[54] REFRIGERATOR SYSTEM FOR TWO-COMPARTMENT COOLING

[75] Inventors: Reinhard Radermacher, Silver Spring; Dongsoo Jung, Ellicott City, both of Md.

[73] Assignee: The University of Maryland, College Park, Md.

[21] Appl. No.: 794,022

[22] Filed: Nov. 19, 1991

[51] Int. Cl.[5] ..... F25B 1/00/1/10; F25B 5/00

[52] U.S. Cl. ..... 62/114; 62/117; 62/198; 62/199; 62/442; 62/502; 62/504; 62/510

[58] Field of Search ..... 62/114, 117, 175, 198, 62/199, 442, 502, 504, 509, 511, 512, 513, 525

[56] References Cited

U.S. PATENT DOCUMENTS

| | | | |
|---|---|---|---|
| 3,808,827 | 5/1974 | Avon et al. | 62/498 |
| 4,317,335 | 3/1982 | Nakagawa et al. | 62/199 |
| 4,416,119 | 11/1983 | Wilson et al. | 62/502 X |
| 4,435,962 | 3/1984 | Mochizuki et al. | 62/199 X |
| 4,474,026 | 10/1984 | Mochizuki et al. | 62/199 X |
| 4,918,942 | 4/1990 | Jaster | 62/510 X |
| 4,987,751 | 1/1991 | Lewen | 62/117 X |
| 5,092,138 | 3/1992 | Radermacher et al. | 62/114 X |
| 5,095,712 | 3/1992 | Narreau | 62/175 X |
| 5,103,650 | 4/1992 | Jaster | 62/510 X |

FOREIGN PATENT DOCUMENTS

| | | | |
|---|---|---|---|
| 1525421 | 11/1989 | U.S.S.R. | 62/502 |
| 811114 | 4/1959 | United Kingdom | 62/502 |

*Primary Examiner*—Henry A. Bennet
*Assistant Examiner*—Christopher B. Kilner
*Attorney, Agent, or Firm*—Oblon, Spivak, McClelland, Maier & Neustadt

[57] ABSTRACT

A refrigeration system for refrigerators having two or more compartments maintained at different temperatures comprises separate cycles for each compartment, each cycle in turn comprising separate evaporator means, heat exchanger means and compressor. To provide for cycle separation, the condenser may be split into separate units, connected by phase separators where appropriate. The system is particularly designed for use in connection with mixed, nonazeotropic refrigerants.

7 Claims, 2 Drawing Sheets

REFRIGERATOR SYSTEM FOR TWO-COMPARTMENT COOLING

FIELD OF THE INVENTION:

This invention pertains to a refrigeration system designed for refrigeration devices maintaining at least two compartments at different temperatures, such as domestic refrigerators wherein a single-refrigeration system serves both freezer and fresh food compartments. The systems are optimized for a nonazeotropic mixed refrigerant or working fluids.

BACKGROUND OF THE PRIOR ART

Most domestic refrigerators have a single refrigeration cycle serving both freezer and fresh food compartments, that is, compartments maintained at two different temperatures. This low-cost approach, while conserving capital expense, is not efficient from a thermodynamic point of view. As the refrigeration cycle must deliver all cooling at 0° F., while the food compartment is generally maintained at a much higher temperature, e.g., 35°–40° F., the compressor works harder, and consumes more electricity than necessary for cooling of the food compartment.

U.S. Pat. No. 4,910,972 provides an improvement on the conventional cycle. This system, designed for use with a single refrigerant, R12, provides a cycle in which the refrigerant leaving the condenser passes a first expansion device and a high-temperature evaporator. In this HTE, half the refrigerant is evaporated, which provides cooling for the refrigerator, or high-temperature compartment. The vapor is separated from the liquid in a phase separator, and the liquid is passed through a second expansion device to a low-temperature evaporator, which provides cooling for the freezer at 0°–5° F. The vapor from the LTE is compressed first in a low-stage compressor, and then mixed with the suction vapor from the high-temperature evaporator, in a second compressor. Analysis indicates an improvement of 35.5% using R12 as the refrigerant.

A further improvement is described in U.S. Pat. No. 4,918,942. In this patent, heat exchanges are added which exchange heat between liquid streams upstream of expansion valves with their respective suction vapors. This further improves the system. Thus, in comparison to the basic design in U.S. Pat. No. 4,910,972, showing a 35.5% improvement in comparison to a single-stage refrigeration cycle, the system of U.S. Pat. No. 4,918,942 gives a 48.1% improvement over the same conventional single system, a significant improvement beyond the two-stage cycle of the '972 patent.

Further improvements are desired. Particularly, improvements which take advantage of the operational characteristics of mixed refrigerant systems are particularly promising.

SUMMARY OF THE INVENTION

A two-stage refrigeration system for cooling separate refrigerator compartments at different temperatures provides twin systems, each comprised of a suction heat exchanger and expansion means connected to an evaporator. In each evaporator, heat exchange takes place which cools the respective compartments. The vapor stream from each evaporator is directed to a compressor. The discharge vapor of the low-temperature compressor feeds into the suction side of the high-temperature compressor. The discharge vapor of the high-temperature compressor in turn feeds a condenser. The condenser is split into two units, separated by a phase separator. The first cycle is fed by the phase separator, the second by the second condenser unit.

In alternative embodiments, the two cycles may be further combined by directing the discharge vapor from the low-temperature compressor unit through the evaporator and suction heat exchanger of the first cycle. Further, the second condenser unit feeding the low-temperature cycle may optionally be in heat-exchange relationship with the evaporator from the first cycle. While this system offers a COP value of 1.9 with a single pure refrigerant, such as R12, which is advantageous, further improvements, giving COP values as high as 2.01 and better are achieved by nonazeotropic refrigerant mixtures, such as a combination of R22/R142b. Thus, the system is particularly optimized for mixed refrigerants.

The provision of a separator between the two condenser sections causes the concentration of the mixtures in the two cycles to be different, thus the respective mixture concentration can be optimized by selecting the relative size of the two condensing units.

DETAILED DESCRIPTION OF THE INVENTION

Figure 1:
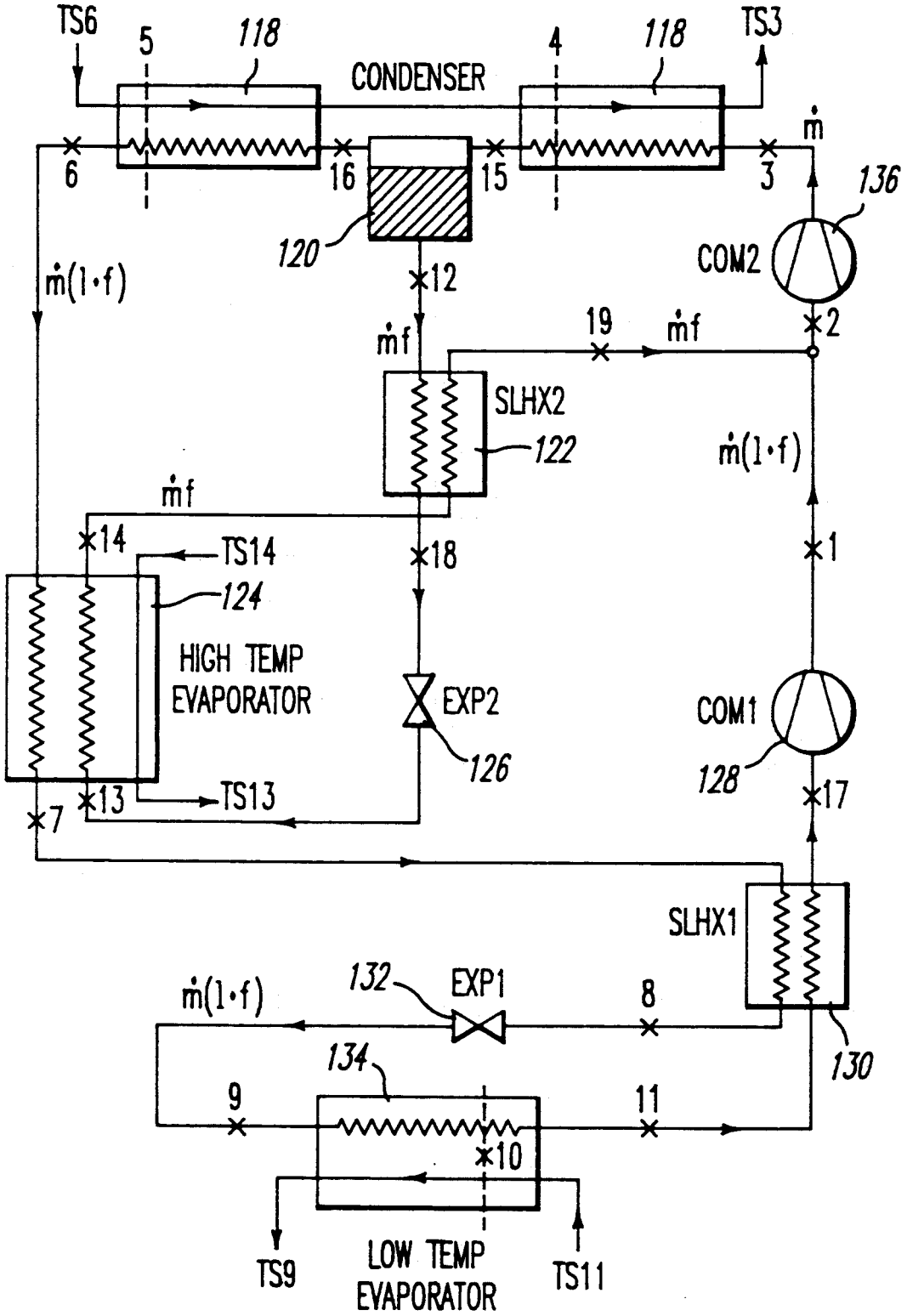
FIG. 1 is a schematic illustration of the two-cycle system of the invention, wherein the outlet vapor from the first compressor is fed directly to the inlet of the second compressor means. Points designated by single and double digit numbers, as well as lower case letters, correspond to points of simulation-based calculations discussed below.

Applicants' invention resides in the discovery that significant improvements in economy can be achieved by 1) using a two-stage cycle and operating it with a refrigerant mixture (all embodiments of this invention) and 2) having the two condensing units provide optimized mixture concentrations to the respective evaporators. Particular advantages can be obtained when using a mixed refrigerant, although pure refrigerants, such as R12, can be used in the system to obtain lesser improvements.

Thus, referring to the drawings, wherein like numbers indicate like units, the system condenser has been split into two units 118. These units are in fluid communication, and separated by, a phase separator means 120. The phase separator means extracts a fraction of the condensate produced in the first condenser means 118 (this may be, but is not necessarily, 100%) and is in liquid communication with a suction heat exchanger 122. The refrigerant passes through the heat exchanger 122, and into an expansion means 126, which flows through the high-temperature evaporator, for cooling the refrigerator compartment, or other compartment maintained at the higher temperature. The refrigerant passes back through the suction heat exchanger and into a first compressor (high-temperature compressor) means 136, which in turn feeds the condenser means 118, located upstream of the phase separator.

Refrigerant condensed in condenser 118 downstream of the phase separator is passed through a second suction heat exchanger 130, and thereafter through an expansion means 132, before passing through the low-temperature evaporator, which cools the freezer compartment, or lower temperature compartment of the refrigerator. The cooled refrigerant is passed through the suction heat exchanger, and then through a compressor means. As illustrated in FIG. 1, the refrigerant passing through the condenser means downstream of the phase separator and into the low-temperature cycle is in heat exchange relationship with the high-temperature evaporator means 124. Computer modeling and experimental analysis have demonstrated that efficiency of performance is not much effected if the communication between the downstream condenser means 118 and the second suction heat exchanger means is not in heat exchange relationship with the high-temperature evaporator. As this alternative is less costly, without loss of efficiency, it is a preferred alternative.

Figure 2:
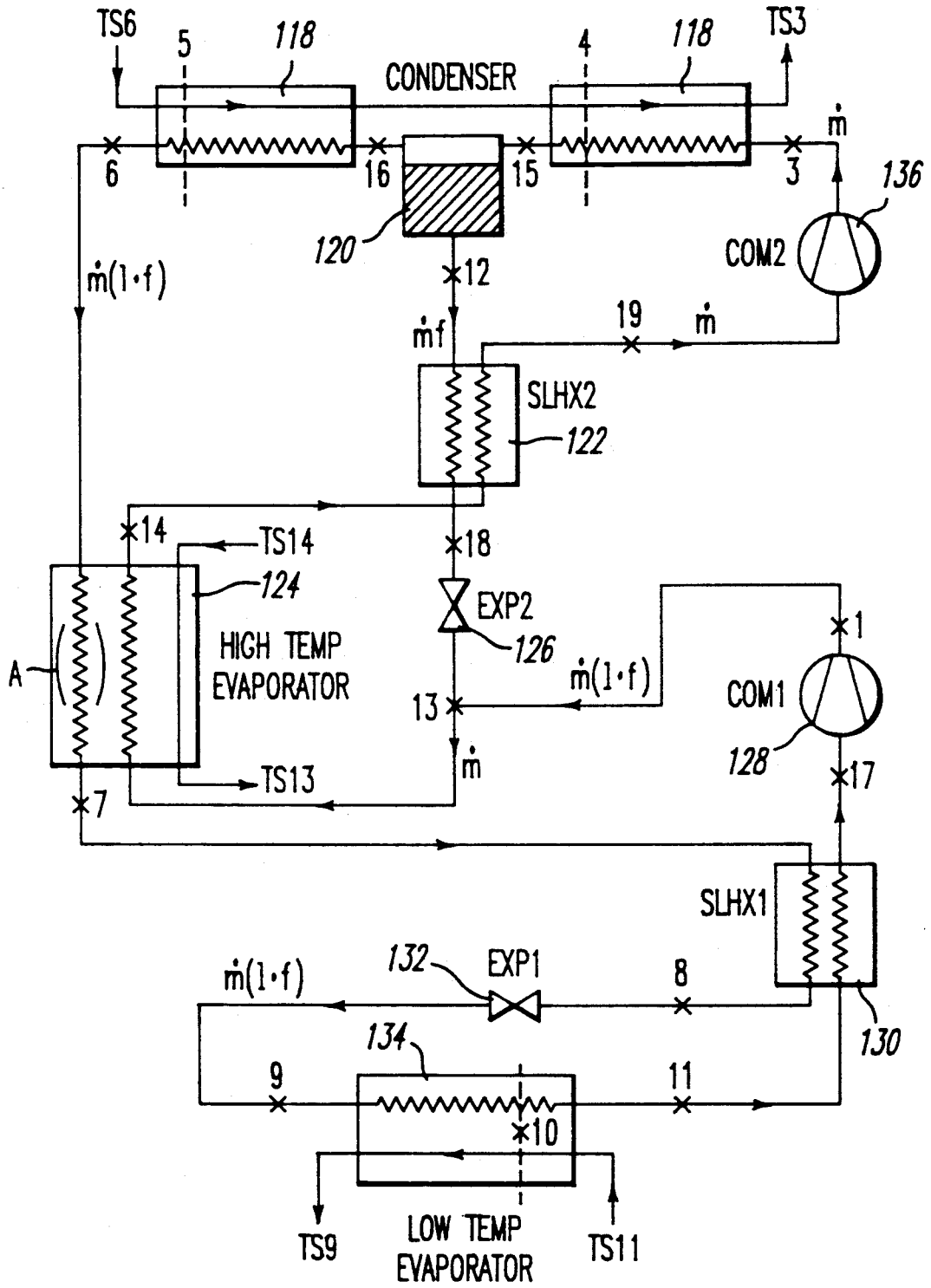
FIG. 2 is a schematic illustration of a second embodiment of the system, wherein the outlet vapor from the compressor means of the second cycle is fed through the evaporator of the first cycle and then onto the first-cycle compressor. Again, single and double digit numbers, as well as lower case letters designate points at which simulation values, discussed below, have been calculated.

The optional heat-exchange relationship between the refrigerant and the downstream condenser means 118, and low-temperature suction heat exchanger 130 is indicated in FIG. 2 by A. Again, in either embodiment, efficiencies remain about the same. In the embodiment illustrated in FIG. 2, whether the two cycles are in heat-exchange relationship at the high-temperature evaporator or not, the output vapor from the compressor means associated with the low-temperature cycle is passed through the high-temperature evaporator, the suction heat exchanger 122 associated therewith and then onto the high-temperature compressor means 136.

Although alternatives are known to those of skill in the art, in preferred embodiments, fluid communication is provided by conduit of appropriate dimension. The condensers, phase separators, evaporators, heat exchangers, expansion valves and compressor means of this system are all conventionally available, and do not constitute an aspect of the invention, per se.

As noted, these systems may be used with either pure or mixed refrigerants. Computer modeling for the embodiments illustrated and discussed above has been conducted. As an example of the type of calculations made in such modeling, Tables 1 and 2 correspond to the embodiments of FIGS. 1 and 2, respectively. As reflected therein, coefficiency of performance values (COP) using the pure refrigerant R12 are impressive, values of 1.754 and 1.917 being obtained. Further computer modeling with mixed refrigerants, such as R22/R142b have given further improvements with COP values above 2. In general, all conventional nonazeotropic mixtures used in refrigeration systems can be employed herein, with the ratio of components running from 10:90–90:10. Exemplary nonazeotropic mixtures include, in addition to R22/R142b, 32/142b, and other specific combinations including 143a/142b, 143a/152a, 32/152a, 22/152a, 22/143a, 22/124, 22/134a and 22/134. These values refer to established refrigerant nomenclature, thus, 124 is 1-chloro-1,2,2-tetrafluoroethane, 134 is 1,1,2,2-tetrafluoroethane, 142b is 1-chloro-1,1-difluoroethane, 143a is 1,1,1-trifluoroethane, 152a is 1,1-difluoroethane and 32 is difluoromethane.

TABLE 1

IDEAL VAPOR COMPRESSION CYCLE ANALYSIS

******** GIVEN PARAMETERS ********
REFRIGERANTS R12 AND R12 ; F = .0000; X = 1.000 MASS FRAC.R12
XOO,XOI(MASS FRAC.) :1.0000 1.0000 MEFZ,MEFD,NCO (CFM) : 25.0 25.0 100.0
HX STREAM TEMPS:SOURCE(IN,OUT,FZ,FD):−15.00 −21.00 3.35 −2.65 C
SINK (IN,OUT) : 32.00 37.71 C
COMPRESSOR EFFICIENCY 1,2 : .6000 .6000
IMPOSED COND & EVAP PRESS. DROPS (KPA): 10.0 10.0
IMPOSED EVAP SUPERHEAT & COND SUBCOOLING (C): 3.0 3.0
UA (FZ & FD EVAP, COND): .01714 .01714 .02143 KW/C
CAPACITY OF HTF (FZ & FD EVAP,COND): .01655 .01655 .05463 KW/C
FZ & FD COOLING LOAD: .09928 .09928 KW
HEAT EXCHANGER CORRECTION FACTOR(E,C): .9000, .9000
FZ & FD EVAP, COND AREA (M*M) : .143 .143 .143
HEAT EX EFF 1, SL HX EFF : .900 .000

******** STATE PARAMETERS ********

| STATE | T (C) HX STR | T (C) REF | P (KPA) | H (KJ/KG) | V (M 3/KG) | S (KJ/KG K) | XL (MASS FRAC) | XV (MASS FRAC) | XQ |
|---|---|---|---|---|---|---|---|---|---|
| 1 COM1 DIS | .0 | 15.1 | 240.6 | 198.8 | 7.78E−2 | .753 | 1.000 | 1.000 | 1.087 |
| 2 COM2 IN | .0 | .5 | 240.6 | 190.0 | 7.31E−2 | .721 | 1.000 | 1.000 | 1.030 |
| 3 COM2 DIS | 37.7 | 92.9 | 1186.0 | 239.4 | 1.85E−2 | .778 | 1.000 | 1.000 | 1.271 |
| 4 COND VST | 36.5 | 49.0 | 1183.9 | 206.5 | 1.46E−2 | .000 | .000 | .000 | .000 |
| 5 COND LST | 32.0 | 48.7 | 1176.1 | 84.8 | 8.21E−4 | .000 | .000 | .000 | .000 |
| 6 COND OUT | 32.0 | 45.7 | 1176.0 | 81.7 | 8.11E−4 | .000 | .000 | .000 | .000 |
| 7 AFTER 6 | .0 | −1.0 | 1176.0 | 35.9 | 7.09E−4 | .000 | .000 | .000 | .000 |
| 8 EXP1 IN | .0 | −1.0 | 1176.0 | 35.9 | 7.09E−4 | .000 | .000 | .000 | .000 |
| 9 EVAP IN | −21.0 | −24.2 | 127.4 | 35.9 | 0.00E+0 | .000 | 1.000 | 1.000 | .133 |
| 10 EVAP VST | −15.1 | −26.2 | 117.6 | 176.7 | 1.38E−1 | .000 | .000 | .000 | .000 |
| 11 EVAP OUT | −15.0 | −23.2 | 117.4 | 178.4 | 1.40E−1 | .000 | .000 | .000 | .000 |
| 12 COND EXT | .0 | 48.8 | 1178.8 | 84.9 | 0.00E+0 | .000 | .000 | .000 | .000 |
| 13 FOOD IN | −2.6 | −6.2 | 250.6 | 84.9 | 0.00E+0 | .000 | 1.000 | 1.000 | .349 |
| 14 FOOD OUT | 3.4 | −7.3 | 240.6 | 185.3 | 7.05E−2 | .000 | .000 | .000 | .000 |
| 15 SEPA IN | 33.6 | 48.8 | 1178.8 | 127.2 | 0.00E+0 | .000 | 1.000 | 1.000 | .348 |
| 16 SEPA OUT | 33.6 | 48.8 | 1178.8 | 206.5 | 0.00E+0 | .000 | .000 | .000 | .000 |
| 17 COMP1 IN | .0 | −23.2 | 117.4 | 178.4 | 1.40E−1 | .724 | .000 | .000 | .000 |
| 18 EXP2 IN | .0 | 48.8 | 1178.8 | 84.9 | 8.21E−4 | .000 | .000 | .000 | .000 |
| 19 AFTER 14 | .0 | −7.3 | 240.6 | 185.3 | 7.05E−2 | .000 | .000 | .000 | .000 |

******** CALCULATED PARAMETERS ********
W1,W2,W,QEFD,QEFZ,QC,QCIN : 14.2 99.0 113.2 99.3 311.8 311.8 (W)

TABLE 1-continued

IDEAL VAPOR COMPRESSION CYCLE ANALYSIS

COP: 1.754 REF. MDOT: .0020038 KG/S PR,PR1,PR2:10.10 2.05 4.93
VCR LOW AND HIGH (KJ/M 3) : 1015.8 678.0
EXTRACTED FRACTION, QUALITY (MASS): .6522 .3478

| | | | | | | |
|---|---|---|---|---|---|---|
| UALMTD (CAL) | | .098112 | .001173 | .002186 | .084756 | .158933 | .065896 |
| MDOT*DH CAL) | | .098112 | .001172 | .002185 | .084756 | .158934 | .065886 |
| Q*F (CAL) | | .098112 | .001173 | .002186 | .084756 | .158933 | .065886 |
| FOOD COMP | | .099285 | .099285 | | | | |
| HXEF1,TRAT1,TRAT2,HRAT1,HRAT2 .900 .900 .000 .000 .000 | | | | | | | |
| DT: | 5.76882 | 8.65586 | 13.61031 | 14.32266 | 12.41416 | 25.86424 | |
| AREA: | .141728 | .001129 | .001071 | .039451 | .085351 | .016985 | |
| ADT: | .817604 | .009772 | .014571 | .565039 | 1.059556 | .439307 | |

TABLE 2

IDEAL VAPOR COMPRESSION CYCLE ANALYSIS

******** GIVEN PARAMETERS ********
REFRIGERANTS R12 AND R12 ; F = .0000; X = 1.000 MASS FRAC.R12
XOO,XOI(MASS FRAC.) :1.0000 1.0000 MEFZ,MEFD,MCO (CFM) : 25.0 25.0 100.0
HX STREAM TEMPS:SOURCE(IN,OUT,FZ,FD):−15.00 −21.00 3.35 −2.65 C
SINK (IN,OUT) : 32.00 37.53 C
COMPRESSOR EFFICIENCY 1,2 : .6000 .6000
IMPOSED COND & EVAP PRESS. DROPS (KPA): 10.0 10.0
IMPOSED EVAP SUPERHEAT & COND SUBCOOLING (C): 3.0 3.0
UA (FZ & FD EVAP, COND): .01714 .01714 .02143 KW/C
CAPACITY OF HTF (FZ & FD EVAP,COND): .01655 .01655 .05463 KW/C
FZ & FD COOLING LOAD: .09928 .09928 KW
HEAT EXCHANGER CORRECTION FACTOR(E,C): .9000, .9000
FZ & FD EVAP, COND AREA (M*M) : .143 .143 .143
HEAT EX EFF 1, SL HX EFF : .900 .900

******** STATE PARAMETERS ********

| STATE | T (C) HX STR | T (C) REF | P (KPA) | H (KJ/KG) | V (M 3/KG) | S (KJ/KG K) | XL (MASS FRAC) | XV (MASS FRAC) | XQ |
|---|---|---|---|---|---|---|---|---|---|
| 1 COM1 DIS | .0 | 36.2 | 240.6 | 211.9 | 8.46E−2 | .797 | 1.000 | 1.000 | 1.171 |
| 2 COM2 IN | .0 | 38.9 | 240.6 | 213.6 | 8.54E−2 | .802 | 1.000 | 1.000 | 1.182 |
| 3 COM2 DIS | 37.5 | 132.6 | 1110.5 | 269.3 | 2.31E−2 | .859 | 1.000 | 1.000 | 1.515 |
| 4 COND VST | 35.7 | 46.1 | 1107.1 | 205.7 | 1.57E−2 | .000 | .000 | .000 | .000 |
| 5 COND LST | 32.0 | 45.8 | 1100.6 | 81.9 | 8.13E−4 | .000 | .000 | .000 | .000 |
| 6 COND OUT | 32.0 | 42.8 | 1100.5 | 78.8 | 8.04E−4 | .000 | .000 | .000 | .000 |
| 7 AFTER 6 | .0 | −1.3 | 1100.5 | 35.6 | 7.09E−4 | .000 | .000 | .000 | .000 |
| 8 EXP1 IN | .0 | −13.4 | 1100.5 | 24.3 | 6.90E−4 | .000 | .000 | .000 | .000 |
| 9 EVAP IN | −21.0 | −24.2 | 127.4 | 24.3 | 0.00E+0 | .000 | 1.000 | 1.000 | .062 |
| 10 EVAP VST | −15.1 | −26.2 | 117.6 | 176.7 | 1.38E−1 | .000 | .000 | .000 | .000 |
| 11 EVAP OUT | −15.0 | −23.2 | 117.4 | 178.4 | 1.40E−1 | .000 | .000 | .000 | .000 |
| 12 COND EXT | .0 | 45.9 | 1103.2 | 82.0 | 0.00E+0 | .000 | .000 | .000 | .000 |
| 13 FOOD IN | −2.6 | −6.2 | 250.6 | 52.6 | 0.00E+0 | .000 | 1.000 | 1.000 | .140 |
| 14 FOOD OUT | 3.4 | −7.3 | 240.6 | 185.3 | 7.05E−2 | .000 | .000 | .000 | .000 |
| 15 SEPA IN | 33.5 | 45.9 | 1103.2 | 131.7 | 0.00E+0 | .000 | 1.000 | 1.000 | .402 |
| 16 SEPA OUT | 33.5 | 45.9 | 1103.2 | 205.6 | 0.00E+0 | .000 | .000 | .000 | .000 |
| 17 COMP1 IN | .0 | −3.4 | 117.4 | 189.7 | 1.53E−1 | .767 | .000 | .000 | .000 |
| 18 EXP2 IN | .0 | 16.6 | 1103.2 | 52.6 | 7.40E−4 | .000 | .000 | .000 | .000 |
| 19 AFTER 14 | .0 | 40.6 | 240.6 | 214.7 | 8.59E−2 | .000 | .000 | .000 | .000 |

******** CALCULATED PARAMETERS ********
W1,W2,W,QEFD,QEFZ,QC,QCIN : 14.3 89.3 103.6 99.3 99.3 302.2 302.2 (W)
COP: 1.917 REF. MDOT: .0016019 KG/S PR,PR1,PR2: 9.46 2.05 4.62
VCR LOW AND HIGH (KJ/M 3) : 1008.6 725.9
EXTRACTED FRACTION, QUALITY (MASS): .5977 .4023

| | | | | | | |
|---|---|---|---|---|---|---|
| UALMTD (CAL) | | .098200 | .001084 | .002004 | .079751 | .118465 | .101956 |
| MDOT*DH CAL) | | .098201 | .001084 | .002004 | .079751 | .118465 | .101941 |
| Q*F (CAL) | | .098200 | .001084 | .002004 | .079751 | .118465 | .101941 |
| FOOD COMP | | .099285 | .099285 | | | | |
| HXEF1,TRAT1,TRAT2,HRAT1,HRAT2 .900 .900 .900 11.304 11.304 | | | | | | | |
| DT: | 5.77051 | 8.65920 | 11.04050 | 11.80597 | 10.27078 | 34.47121 | |
| AREA: | .141814 | .001043 | .001210 | .045034 | .076895 | .019718 | |
| ADT: | .818337 | .009035 | .013360 | .531673 | .789768 | .679704 | |

Although applicants do not wish to be bound by this theory, it appears that the improvements obtained in mixed refrigerants, with respect to pure refrigerants, in the two-cycle refrigerant system disclosed herein can be traced to two different mixture characteristics. First, nonazeotropic mixtures, such as those discussed above exhibit a gliding temperature during a constant pressure phase change process. This has been demonstrated to reduce thermodynamic irreversibility, reducing energy demands. Second, in a mixed system, the concentration of the circulating mixture is different in the evaporators. Higher content of low-boiling refrigerant in the low-temperature evaporator increases the pressure, reducing the amount of work done by the compressor associated with the low-temperature cycle. For other compressor designs, it may be advantageous to connect the liquid outlet of 120 to 124 (at point 6) and the outlet at point 6 to the inlet of 122 at 12. Thus, the concentrations in the two evaporators are exchanged. In the latter case, the pressure ratio of the high-temperature compressor is reduced.

Variations in the system may be practiced without significantly effecting efficiency. Thus, variations in the arrangement of heat exchangers, together with control variations, can be incorporated without departing from the inventive concept disclosed herein. Further, in refrigeration devices with more than two temperature levels, additional cycles are required. As another variation, there may not be heat exchange with an external heat transfer fluid on the high evaporator temperature level. This corresponds to a high-temperature lift refrigeration cycle, or heat pump. Such variations remain within the scope of the invention, save as limited by the claims set forth below.

What is claimed is:

1. A refrigeration system for a refrigerator with at least two compartments maintained at different temperatures, comprising a refrigerant circulated through a refrigeration means comprising:

first and second condenser means in fluid communication with, and separated by, a phase separator means, said phase separator means being in fluid communication through a first heat exchange means and then a first fluid expansion means with a first evaporator means, said first evaporator means being in turn in fluid communication with a first compressor means in fluid communication with said first condenser means, said second condenser means being in fluid communication through a second heat exchanger and then a second fluid expansion means with a second evaporator means, said second evaporator mans being in fluid communication with a second compressor means which is in turn in fluid communication with said first compressor means through said first evaporator means and then said first heat exchange means.

2. The refrigeration system of claim 1, wherein said second compressor means is in direct fluid communication with said first compressor means.

3. The refrigeration system of claim 1, wherein said fluid communication between said second condenser means and said second heat exchanger is in heat exchange relationship with said first evaporator means.

4. The refrigeration system of claim 1, wherein said refrigerant consists essentially of one refrigerant, or azeotropic mixture.

5. The refrigeration system of claim 1, wherein said refrigerant is comprised of a nonazeotropic mix of at least two refrigerants.

6. The refrigeration system of claim 5, wherein said first and second condenser means are of unequal condensing capacity, the liquid refrigerant flows therefrom thereby having different concentrations of refrigerants.

7. The refrigeration system of claim 6, wherein the amount of liquid refrigerant flowing from said first condensing means is not equal to the amount of liquid flowing from said second condensing means.

* * * * *